United States Patent [19]

Wing, Jr. et al.

[11] Patent Number: 4,907,724

[45] Date of Patent: Mar. 13, 1990

[54] DISPOSABLE PRE-MIX BEVERAGE PACKAGE FOR USE IN OUTER SPACE

[75] Inventors: George R. Wing, Jr., Acworth; Arthur G. Rudick, Marietta, both of Ga.

[73] Assignee: The Coca-Cola Company, Atlanta, Ga.

[21] Appl. No.: 764,251

[22] Filed: Aug. 9, 1985

[51] Int. Cl.[4] ..... B65D 35/56

[52] U.S. Cl. ..... 222/105; 222/527; 206/525; 215/1 A

[58] Field of Search ..... 222/541, 526–530, 222/95, 105, 183, 131, 386.5; 220/85 SP, 90.2, 449; 229/7 S; 215/1 A; 206/525; 426/85, 115, 117–118

[56] References Cited

U.S. PATENT DOCUMENTS

| | | | |
|---|---|---|---|
| 3,199,742 | 8/1965 | Hill | 222/529 X |
| 3,233,779 | 2/1966 | Cornelius . | |
| 3,273,760 | 9/1966 | Frankenberg | 222/95 X |
| 3,294,289 | 12/1966 | Bayne et al. | 222/95 |
| 3,454,197 | 7/1969 | Thompson | 222/541 X |
| 4,266,698 | 5/1981 | Rausing | 222/528 |
| 4,305,521 | 12/1981 | Komatsuta et al. | 220/90.2 |

*Primary Examiner*—Joseph J. Rolla

*Attorney, Agent, or Firm*—Birch, Stewart, Kolasch & Birch

[57] ABSTRACT

A package for dispensing a carbonated beverage pre-mix at a controlled flow rate in the micro-gravity conditions of outer space comprising a rigid outer container, a collapsible bag in the container, a flexible drinking tube attached to the bag which may curl up in a storage position within the container and extend to a drinking position out of the container and a pinch valve on the tube. Positive pressure is applied to the collapsible container by $CO_2$ gas in the container surrounding the bag to maintain the carbonation of the pre-mix during storage. The pre-mix is dispensed from the tube directly into the astronaut's mouth upon opening of the pinch valve.

6 Claims, 1 Drawing Sheet

DISPOSABLE PRE-MIX BEVERAGE PACKAGE FOR USE IN OUTER SPACE

BACKGROUND OF THE INVENTION

The present invention relates to a package for dispensing a carbonated beverage pre-mix directly into a consumer's mouth in the micro-gravity conditions of outer space. More specifically, the present invention relates to a collapsible container for a carbonated beverage pre-mix disposed within a pressurized storage container, a lid of said collapsible container being removable from the storage container just prior to consumption of the carbonated beverage pre-mix. The pressure is relieved from the rigid storage container just prior to consumption, however the collapsible bag stays inside the rigid can during consumption.

It is known that under zero or micro-gravity conditions of outer space, that beverages cannot be poured from a vessel directly into a consumer's mouth. They must be forced out of the vessels or packages, under positive pressure or sucked out through a straw, directly into the mouth of the astronaut.

Furthermore, the container utilized for dispensing a food or beverage must be of a collapsible volume type in order to preclude the creation of an air space or pocket within the container, the location of which cannot be controlled due to the substantially zero gravity conditions.

Examples of food dispensing containers for use in outer space are illustrated in U.S. Pat. Nos. 3,227,308 and 3,273,760, both to Frankenberg.

While the food dispensing containers of Frankenberg are suitable for dispensing food and some liquids, they would not be suitable for dispensing a carbonated beverage pre-mix in outer space under the micro-gravity conditions that exist.

SUMMARY OF THE INVENTION

Accordingly, it is a primary object of the present invention to provide a package for dispensing a carbonated beverage pre-mix directly into a consumer's mouth in the zero or micro-gravity conditions of outer space.

It is a further object of the present invention to provide a micro-gravity pre-mix package suitable for use in outer space which will maintain substantially constant the carbonation level (the amount of $CO_2$ in solution) of the pre-mix during storage up until the time that the beverage is consumed.

These and other objects of the present invention are fulfilled by providing a package for dispensing a carbonated beverage pre-mix directly into a consumer's mouth in the micro-gravity conditions of outer space, comprising:

(a) a rigid container having a removable lid portion for opening and closing the container;

(b) a collapsible bag disposed within the rigid container, said bag containing the carbonated beverage pre-mix;

(c) a drinking tube coupled to said bag for dispensing said carbonated beverage directly into the consumer's mouth, said drinking tube being flexible and foldable within said rigid container during a storage position and extending outside said rigid container to the consumer's mouth during a drinking position;

(d) a valve associated with said tube for starting or stopping the flow of carbonated beverage therethrough;

(e) manual actuator means for opening or closing said valve to start or stop said flow, respectively; and (f) gas disposed in said rigid container around said collapsible bag having a sufficient initial pressure to ensure that the carbonation of said carbonated beverage pre-mix remains in solution while the rigid container is closed by said removable lid portion.

The removable lid portion is coupled to the drinking tube by a conical projection on the underside thereof which is force fit into the tube end. Accordingly, when the lid portion is removed by grasping a pull tab connected thereto, the tube is pulled from the storage position in the container to a drinking position extending to the consumer's mount. As the lid portion is moved further the tube end pops free from the projection leaving it exposed for use as a straw.

The valve and manual actuator are preferably a pinch valve which normally squeezes the tube closed and permits it to open when manually released.

BRIEF DESCRIPTION OF THE DRAWINGS

The objects of the present invention and the attendant advantages thereof will become more readily apparent by reference to the drawings, like reference numerals referring to like parts, wherein.

DETAILED DESCRIPTION OF PREFERRED EMBODIMENTS

Figure 1:
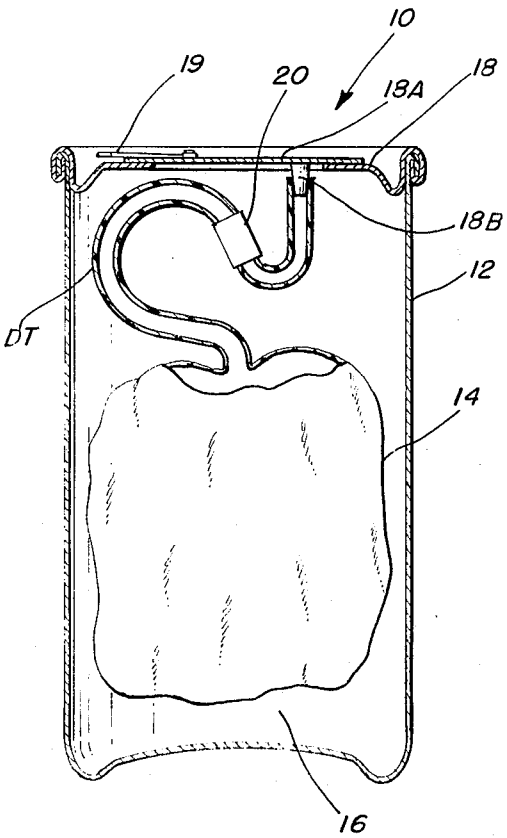
FIG. 1 is a cross-sectional view in side elevation of the package of the present invention in a closed, storage position.

Referring in detail to FIG. 1 there is illustrated a pre-mix beverage package according to the present invention generally designated 10. The package 10 is enclosed in a rigid outer container 12 such as a standard metal or plastic beverage can. Inside of the can 12 is a flexible and collapsible bag 14 such as a "bag-in-box" bag filled with the carbonated beverage pre-mix desired. Attached to the bag or integrally-formed therewith is a flexible drinking tube DT with a pinch value 20 thereon. The open end of the tube DT is lightly press fit onto a truncated conical projection 18B securely fastened to the underside of a removal lid portion 18A of a conventional can lid 18. A pull tab 19 is secured to the removable lid portion 18A for opening the container 12 when consumption of the pre-mix beverage is desired. Otherwise, the removable lid portion 18A is sealed to lid 18 during storage and transportation of the package. The area inside of the container 12 surrounding the bag 14 is filled with a counterpressured gas 16 such as $CO_2$ to a pressure sufficient to keep the carbonation of the pre-mix within the bag in solution during storage and shipment. The opening that is left in the lid 18 after the pull tab removes removable lid portion 18A must be large enough to permit the pinch valve 20 to easily pass therethrough but small enough preferably to keep a bag 14 filled with pre-mix from passing through the opening.

Figure 3:
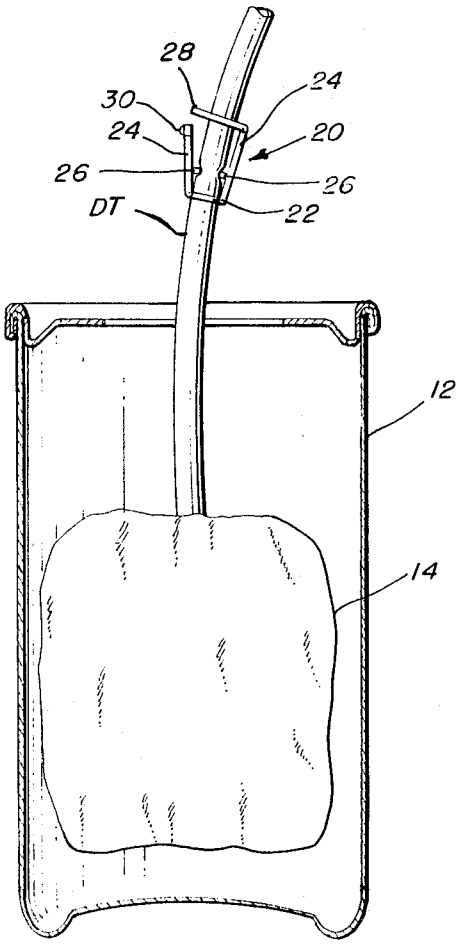
FIG. 3 is a cross-section view in side elevation of the package of the present invention with the lid completely removed and the drinking tube extending to a drinking position.

The pinch valve 20 may be of any conventional type which squeezes the tube DT between open and closed positions. One preferred embodiment of this pinch valve is illustrated in FIG. 3. This pinch valve 20 may include a base 22 in upwardly extending movable arms 24 having projections 26 on the inside thereof for pinching the tube DT. In the position illustrated in FIG. 3, the pinch valve is open and the pre-mix beverage is free to flow through the tube. In the storage position and, when it is not desired to drink the beverage, the pinch valve is closed by snapping upper portion 28 over latch 30 to thereby compress projections 26 against the walls of tube DT to thereby close the tube and preclude the flow of beverage therethrough. Any other form of conventionally-known pinch valve could be utilized without departing from the spirit and scope of the present invention.

Figure 2:
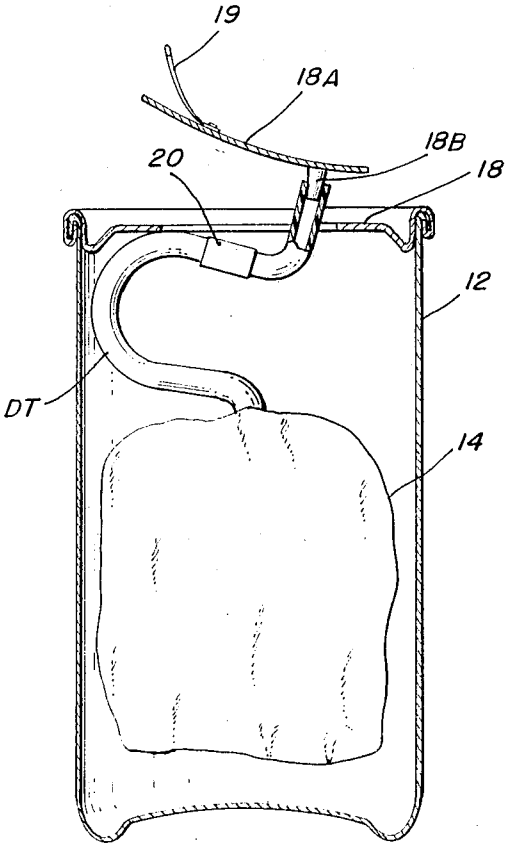
FIG. 2 is a cross-sectional view in side elevation of the package of FIG. 1 illustrating the lid thereof being removed.

FIGS. 1–3 collectively illustrate the operation of the pre-mix beverage package of the present invention. FIG. 1 illustrates the pre-mix package of the present invention in a storage position wherein the bag 14, drinking tube DT, and pinch valve 20 are sealed within the rigid outer container 12. To open the container 12 the pull tab 19 is grasped by an operator's fingers and pulled up as illustrated in FIG. 2. This vents the $CO_2$ counterpressure within the container 12 and begins to pull the drinking tube DT and pinch valve 20 out of the container. As the pull tab 19 and associated removable lid portion 18A continued to be pulled away from the container 12, the drinking tube DT is pulled to a fully extended position in preparation for beverage consumption as illustrated in FIG. 3. When the drinking tube DT is fully extended the frusto-conical projection 18B can be gently removed from the tube and the pull tab 19 and associated removable lid portion 18A discarded. The consumer or astronaut may then drink the pre-mix beverage within the bag 14 by placing the end of tube DT inside the mouth; opening the pinch valve; and sucking the pre-mix beverage from the bag 14 through the drinking tube DT. When empty the entire package including the rigid outer container 12 and the collapsible bag 14 with the associated drinking tube DT and pinch valve 20 may be discarded.

It should be understood that the package of the present invention may be modified as would occur to one of ordinary skill in the art without departing from the spirit and scope of the present invention.

What is claimed is:

1. A package for storing and dispensing a carbonated beverage pre-mix directly into a consumer's mouth in the micro-gravity conditions of outer space comprising:

(a) a rigid container having a removable lid portion for opening the container;

(b) a collapsible bag disposed within the rigid container, said bag containing the carbonated beverage pre-mix;

(c) a drinking tube coupled to said bag for dispensing said carbonated beverage directly into the consumer's mouth, said drinking tube being flexible and foldable within said rigid container in a storage position and extending outside said rigid container to the consumer's mouth in a drinking position;

(d) a valve associated with said tube for starting or stopping the flow of carbonated beverage therethrough;

(e) manual actuator means for opening or closing said valve to start or stop said flow, respectively;

(f) gas disposed in said rigid container around said collapsible bag, said gas having a sufficient initial counter pressure to ensure that the carbonation of said carbonated beverage pre-mix remains in solution when the rigid container is closed by said removable lid portion; and (g) means for coupling said removable lid portion and drinking tube together so that when said lid portion is removed from said container the drinking tube is pulled from the storage position to the drinking position, whereby said means for coupling is selectively removable by the consumer at the time of consumption.

2. The package of claim 1 further including a pull tab secured to said removable lid portion for opening the container.

3. The package of claim 1 wherein said rigid outer container has the general appearance of a pre-mix beverage can.

4. The package of claim 1 wherein said means for coupling is a frusto-conical projection securely fastened to the underside of said removable lid portion such that the open end of said drinking tube is press-fit onto said projection.

5. The package of claim 1 wherein said valve is a pinch valve normally squeezing said drinking tube closed and for opening said tube when manually actuated.

6. The package of claim 5 wherein said removable lid portion is of a sufficient size to permit said pinch valve to pass therethrough but not large enough to permit a full collapsible bag to pass therethrough.

* * * * *